US006899327B2

(12) United States Patent
Shimizu et al.

(10) Patent No.: US 6,899,327 B2
(45) Date of Patent: May 31, 2005

(54) SHEET GUIDE APPARATUS

(75) Inventors: You Shimizu, Toride (JP); Shigenori Iwabuchi, Toride (JP); Yutaka Yuasa, Toride (JP); Koichi Ohrui, Toride (JP)

(73) Assignee: Komori Corporation, Tokyo (JP)

( * ) Notice: Subject to any disclaimer, the term of this patent is extended or adjusted under 35 U.S.C. 154(b) by 22 days.

(21) Appl. No.: 10/408,127

(22) Filed: Apr. 8, 2003

(65) Prior Publication Data

US 2003/0189286 A1 Oct. 9, 2003

(30) Foreign Application Priority Data

Apr. 8, 2002 (JP) ..... 2002-104724
Jul. 17, 2002 (JP) ..... 2002-207920
Oct. 29, 2002 (JP) ..... 2002-313667

(51) Int. Cl.[7] ..... B65H 5/00

(52) U.S. Cl. ..... 271/276; 271/275; 271/277; 101/230; 101/231

(58) Field of Search ..... 271/276, 277, 271/275, 307, 310, 314; 101/229, 230, 231

(56) References Cited

U.S. PATENT DOCUMENTS 4,384,524 A * 5/1983 Simeth et al. ..... 101/232
5,127,329 A * 7/1992 DeMoore et al. ..... 101/420
5,398,925 A * 3/1995 Zeltner ..... 271/276
5,456,178 A * 10/1995 Henn et al. ..... 101/407.1
5,816,155 A * 10/1998 Stephan ..... 101/232
6,089,157 A * 7/2000 Becker et al. ..... 101/230
6,135,026 A * 10/2000 Kalbantner et al. ..... 101/232
6,435,088 B2 * 8/2002 Fujimoto ..... 101/232
6,457,409 B2 * 10/2002 Fujimoto ..... 101/232
6,477,951 B2 * 11/2002 Fujimoto ..... 101/232
6,585,263 B1 * 7/2003 Bredenberg et al. ..... 271/276
6,722,277 B2 * 4/2004 Stephan ..... 101/231
6,729,233 B2 * 5/2004 Knopp et al. ..... 101/232
2002/0096068 A1 7/2002 Frankenberger et al.

FOREIGN PATENT DOCUMENTS

EP 1123804 A1 8/2001
EP 1314555 A1 5/2003
GB 2297542 A 8/1996
JP 2001-293843 A 10/2001
JP 2001-293844 A 10/2001

* cited by examiner

*Primary Examiner*—Donald P. Walsh
*Assistant Examiner*—Matthew J. Kohner
(74) *Attorney, Agent, or Firm*—Birch, Stewart, Kolasch & Birch, LLP

(57) ABSTRACT

A sheet guide apparatus comprises gripper devices for holding and transporting a printed sheet, an impression cylinder and a transfer cylinder for holding and transporting the printed sheet received from the gripper device, and a first guide device for guiding the printed sheet being transported. A front end portion of the first guide device is located upstream, in the flow direction of the printed sheet, from a transfer position, where the printed sheet is transferred from the gripper device to the impression cylinder, and the front end portion of the first guide device is also located near the transfer position. Suction holes opening in a front end portion of a plate-shaped guide of the first guide device are provided for sucking air. The sheet guide apparatus suppresses fluttering or instability of the sheet.

12 Claims, 12 Drawing Sheets

SHEET GUIDE APPARATUS

The entire disclosure of Japanese Patent Applications No. 2002-104724 filed on Apr. 8, 2002, No. 2002-207920 filed on Jul. 17, 2002, and No. 2002-313667 filed on Oct. 29, 2002, including specification, claims, drawings, and summary, is incorporated herein by reference in its entirety.

BACKGROUND OF THE INVENTION

1. Field of the Invention

This invention relates to a sheet guide apparatus which is provided, for example, in a printing press for printing on a sheet, or a coating device for applying a coating onto a sheet, and which is adapted to transport the sheet in a stable state.

2. Description of the Related Art

In a multicolor (e.g., four-color) sheet-fed printing press, as shown in FIG. 13, transfer cylinders (intermediate cylinders) 104 are arranged between printing units 103*a* to 103*d* in a printing section 102 located between a feeder 100 and a delivery unit 101. A printed sheet is moved from an impression cylinder 105 of the preceding printing unit to the transfer cylinder 104, and then to an impression cylinder 105 of the succeeding printing unit via gripper devices (sheet gripping devices; not shown). The printing press for thin sheets employs the transfer cylinder 104 of a cylindrical shape. Whereas the printing press for thick sheets employs a skeleton cylinder so that the thick sheet having nerve will not be warped greatly.

In recent years, the printing press for both of thin sheets and thick sheets has been demanded, and the printing press using skeleton cylinders and suitable for thin sheets and thick sheets has appeared. The weakness of this printing press is in handling thin sheets, as will be understood from the above description. A thin sheet without nerve is not supported by the cylinder, and thus makes an unstable motion, thereby causing a printing trouble. This is true of the coating machine for applying a coating onto a sheet. If the sheet is thin, a coating failure occurs. Conventionally, therefore, various sheet guide devices (see sheet guide devices 106 in FIG. 13) have been provided along transfer cylinders, constructed as skeleton cylinders, for transferring a sheet to impression cylinders, in order to stabilize the sheet being transported, thereby preventing a printing trouble or a coating failure.

Japanese Unexamined Patent Publication No. 2001-293843, for example, discloses the following technique: Air within an air chamber, provided at a back site of a sheet guide (see the sheet guide device 106 in FIG. 13) downstream in the direction of sheet transport, is ejected in a direction along the direction of rotation of an impression cylinder, as a transport cylinder, to generate a negative pressure on the lower surface of a sheet passing over an end portion of the sheet guide surface, thereby imparting moderate tension to the sheet and stabilizing the behavior of the sheet on the impression cylinder as the transport cylinder. Also, air near the position of transfer of the sheet is sucked to avoid scattering of air and make the sheet transferred smoothly from the intermediate cylinder to the impression cylinder.

Japanese Unexamined Patent Publication No. 2001-293844 discloses the feature that suction holes are provided in a sheet guide surface on a downstream side of a sheet guide (see the sheet guide device 106 in FIG. 13), and air near the front end of the sheet guide is sucked through these suction holes and suction holes provided in the wall surface of a suction chamber of the sheet guide, whereby fluttering of an end portion of the sheet or instability of the sheet is suppressed.

The foregoing earlier technologies, however, are unable to stabilize the sheet transported in a region which is present between the front end of the guide member and the position of transfer and where the sheet is not guided by the guide member. That is, according to Japanese Unexamined Patent Publication No. 2001-293843, a negative pressure generated by ejection of air is so weak that this negative pressure exerts an extremely low effect on the above-mentioned region. Moreover, the suction holes are remote from this region, so that a negative pressure due to suction through these suction holes exerts an extremely low effect on the region. Thus, the sheet cannot be stabilized in this region, causing a printing trouble.

According to Japanese Unexamined Patent Publication No. 2001-293844 as well, the suction holes are remote from the above-mentioned region, so that a negative pressure due to suction through these suction holes exerts an extremely low effect on the region. Thus, the sheet cannot be stabilized in this region, causing a printing trouble. Furthermore, a suction force ascribed to the suction holes provided in the sheet guide surface on the downstream side of the sheet guide is difficult to adjust. A weak suction force cannot suppress instability of the sheet. A strong suction force, on the other hand, causes the sheet to move while keeping hard contact with the guide surface, causing scratches or cracks to the sheet.

Besides, the printed sheet is transferred from the impression cylinder to the transfer cylinder, and it has been found that after gripping change to the transfer cylinder, the printed sheet gradually increases in instability, seriously affecting printing quality. To suppress this sheet instability, air may be blown through a discharge nozzle 107 from above an impression cylinder 105, as shown in FIG. 12, to suppress sheet instability. However, if air is blown onto the trailing edge of a printed sheet W, sheet instability is likely to occur on the trailing edge of the printed sheet W.

SUMMARY OF THE INVENTION

The present invention has been conceived in an attempt to solve the problems with the earlier technologies. Its object is to provide a sheet guide apparatus designed to suppress fluttering or instability of a sheet transported in a region which is present between the front end of the guide member and the position of transfer and where the sheet is not guided by the guide member, and to prevent scratches or cracks of the sheet.

A sheet guide apparatus according to the present invention, for attaining the above object, comprises: transport means for holding and transporting a sheet; a first transport cylinder for holding and transporting the sheet received from the transport means; and a guide member for guiding the transported sheet, a front end portion of the guide member being located upstream, in a sheet transport direction, from a transfer position, where the sheet is transferred from the transport means to the first transport cylinder, the front end portion of the guide member being also located near the transfer position, and wherein first suction holes opening in an extreme front end portion of the guide member are provided for sucking air.

In the sheet guide apparatus, the guide member may include guide portions provided with spacing in the width direction of the sheet, and the extreme front end portion may comprise the front ends of the guide portions.

In the sheet guide apparatus, the first transport cylinder may include holding means for holding the sheet, the guide member may include a plate-shaped member extending in the width direction of the sheet and disposed near the transfer position, and the spacing of the guide member may be defined by notch portions provided in an end portion of the plate-shaped member facing the transfer position, the notch portions corresponding to the holding means.

The sheet guide apparatus may further comprise: a second transport cylinder for transferring the sheet to the transport means; and suction means for sucking air present between the second transport cylinder and the sheet located downstream, in the sheet transport direction, from a transfer position, where the sheet is transferred from the second transport cylinder to the transport means, and the suction means may have second suction holes at a position where the second suction holes are not closed with the transported sheet.

In the sheet guide apparatus, the second suction holes of the suction means may be formed in a front end portion of the guide member at an upstream side in the sheet transport direction.

The sheet guide apparatus may further comprise air discharge means for discharging air onto the sheet held on the first transport cylinder to suppress instability of the sheet.

In the sheet guide apparatus, the air discharge means may be composed of first air discharge means for blowing air toward the circumferential surface of the first transport cylinder located downstream, in a sheet flow direction, from the transfer position of the sheet, the blowing being performed in a direction nearly perpendicular to the printed surface or coated surface of the sheet, and second air discharge means for blowing air in a direction opposite to the sheet flow direction.

In the sheet guide apparatus, the air discharge means may have the first air discharge means and the second air discharge means connected to a discharge air source, and the second air discharge means may include a valve for establishing and cutting off supply of discharge air.

Thus, air in a region, which is present between the front end of the guide member and the transfer position and where the printed sheet is not guided by the guide member, is directly sucked through the suction holes opening in the front end portion of the guide member for sucking air, whereby a strong negative pressure can be generated in this region. Thus, the sheet being transported can be attracted to the circumferential surface of the transport cylinder to suppress the fluttering or instability of the sheet. When the sheet guide apparatus is applied to a printing press or a coating device, a printing trouble or a coating failure due to the fluttering or instability can be prevented. Furthermore, air is sucked through the front end portion of the guide member, where the suction holes are not closed with the sheet. Thus, the sheet does not make hard contact with the guide member, so that scratches or cracks of the sheet are prevented. Besides, the number of components can be reduced, because the guide member can serve both of a guide function and a suction function.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Embodiments of a sheet guide apparatus according to the present invention will now be described in detail with reference to the accompanying drawings, which in no way limit the invention.

First Embodiment

Figure 1:
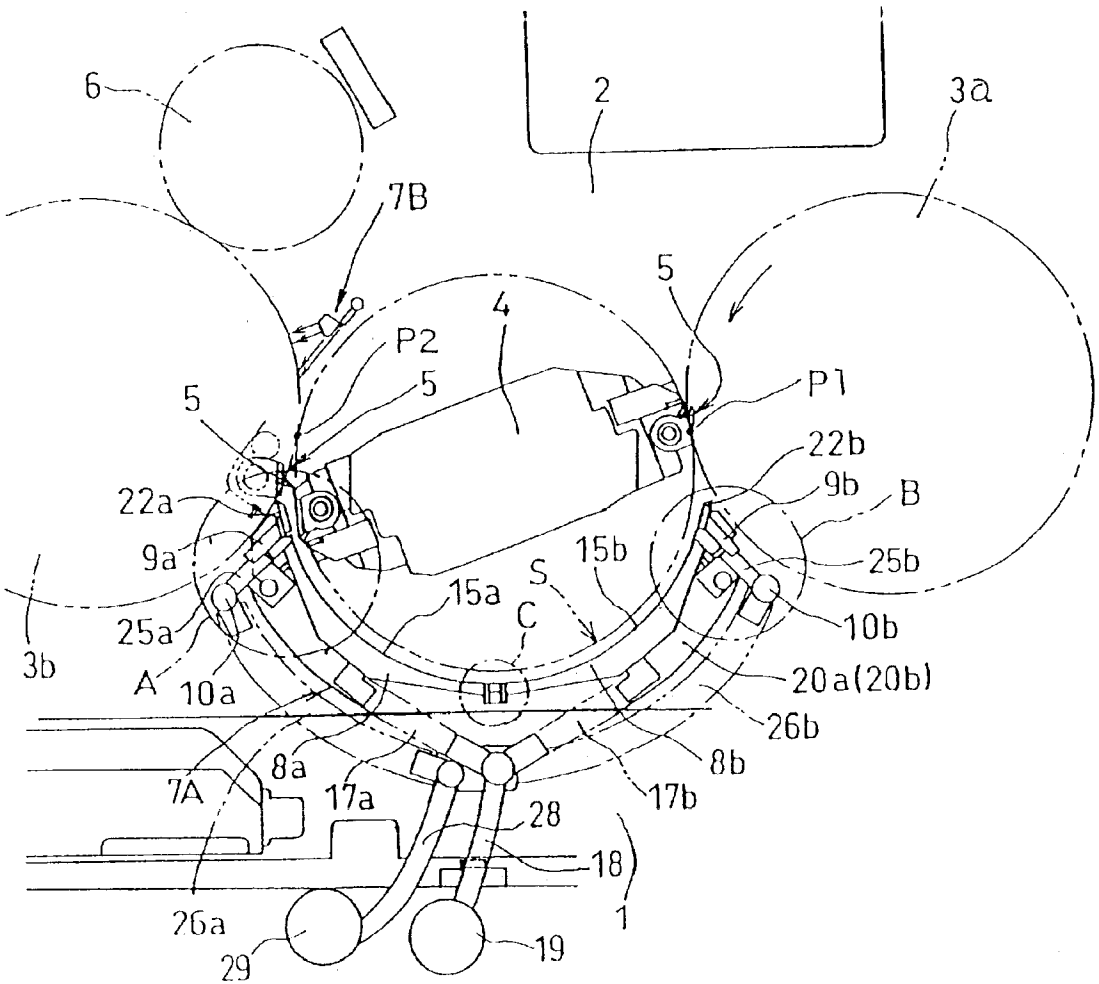
FIG. 1 is a side view of essential parts of a multicolor sheet-fed printing press showing a first embodiment of the present invention.
Figure 2:
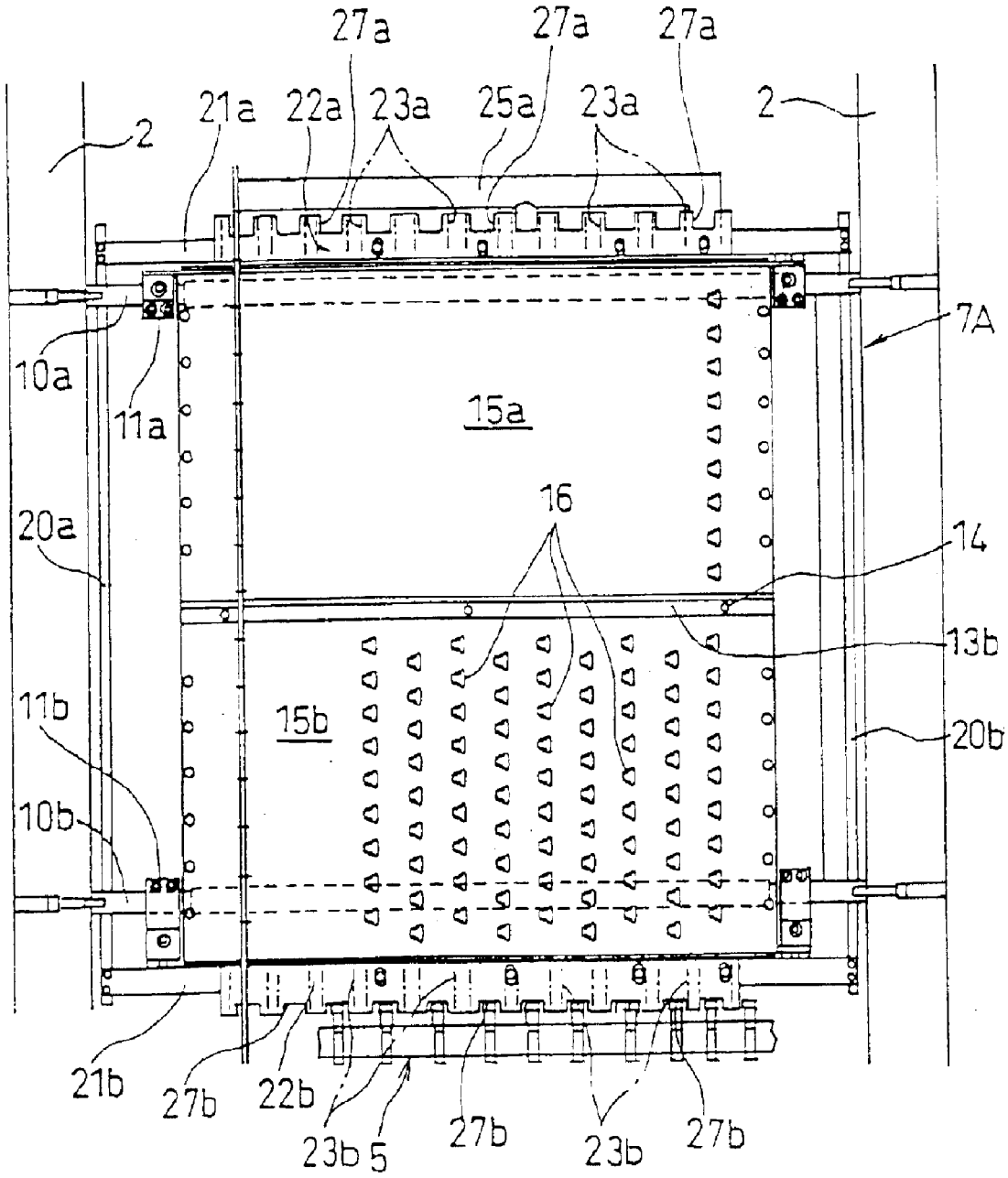
FIG. 2 is a plan view of a first guide device (guide member) in the printing press.
Figure 3:
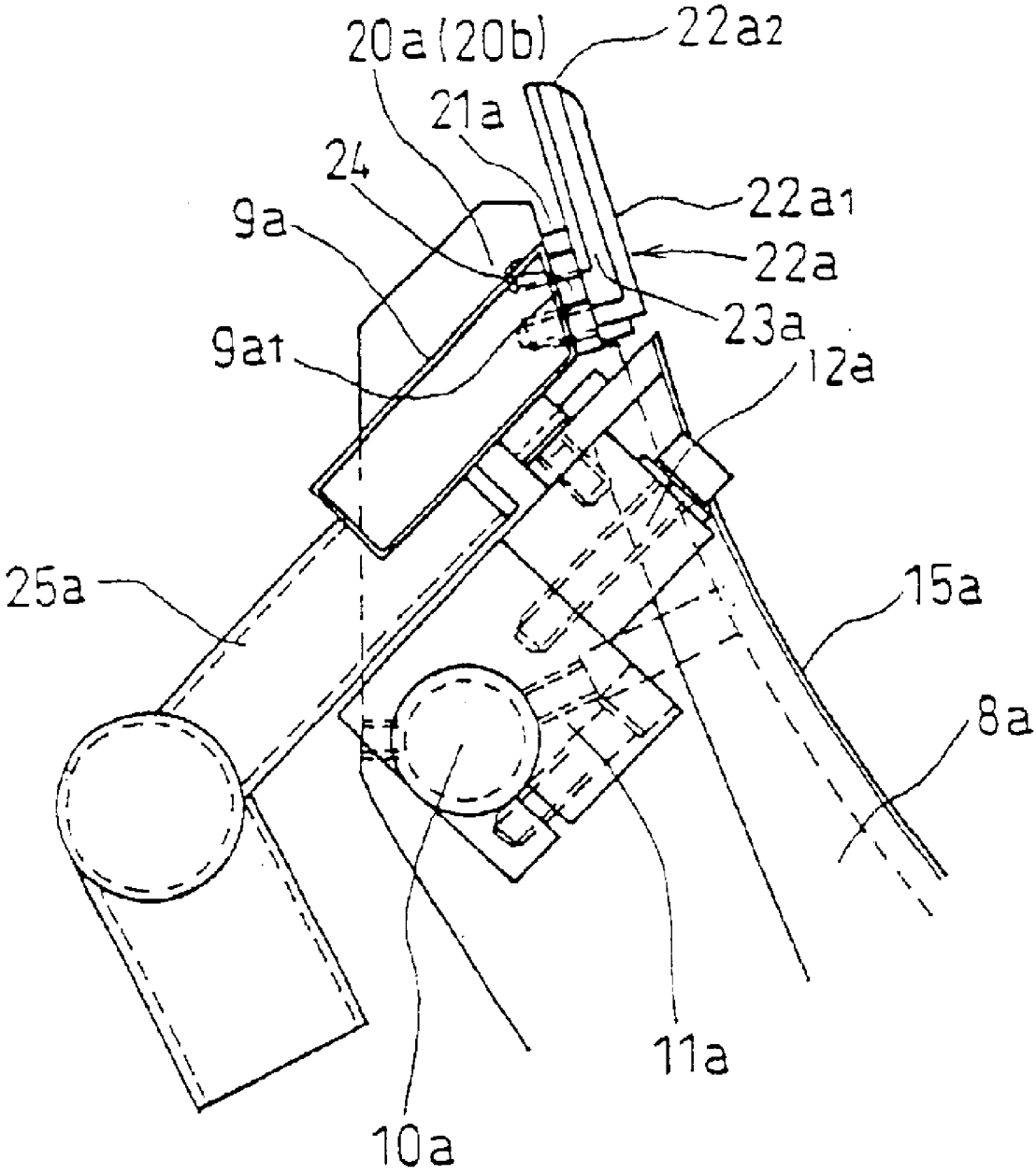
FIG. 3 is an enlarged view of an A portion in the printing press of FIG. 1.
Figure 4:
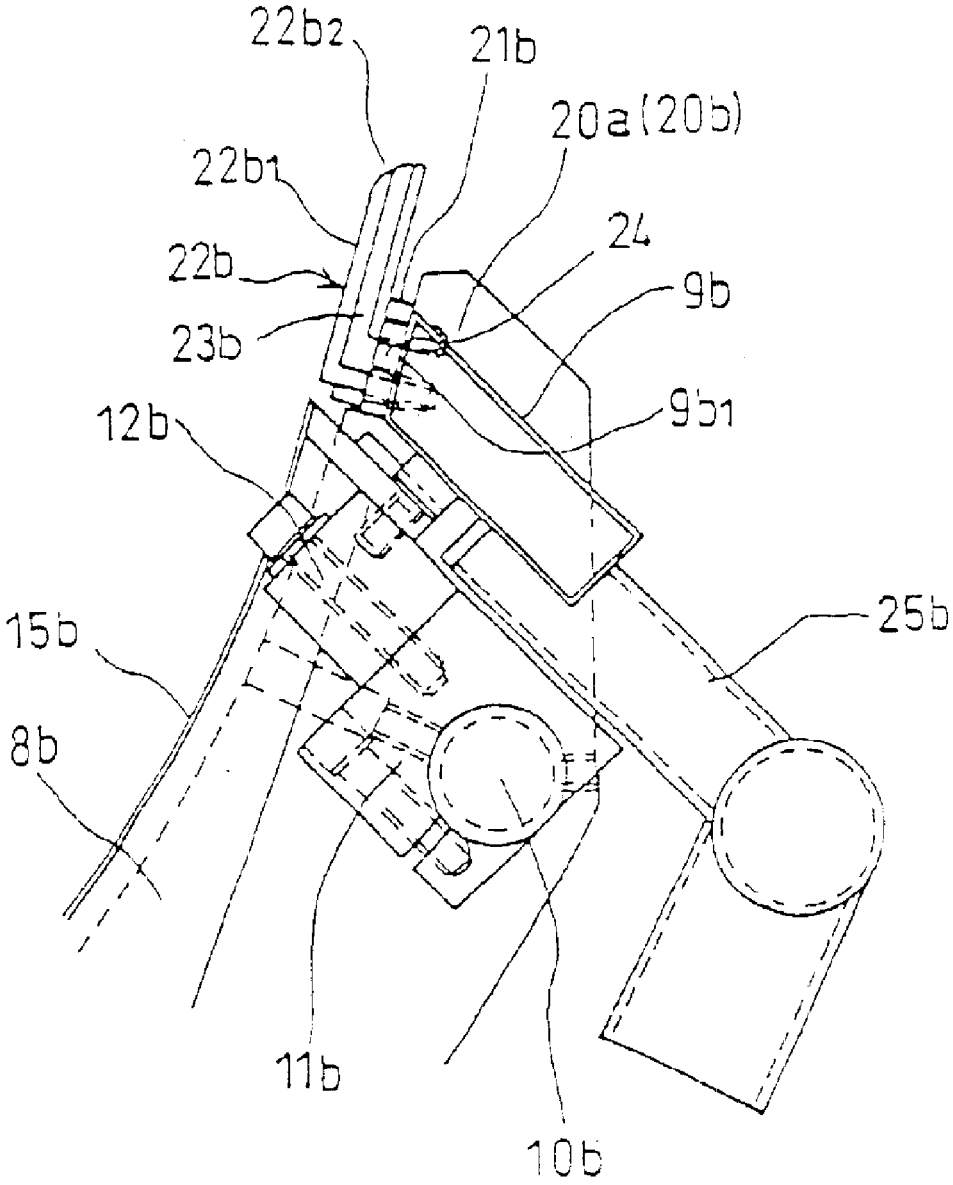
FIG. 4 is an enlarged view of a B portion in the printing press of FIG. 1.
Figure 5:
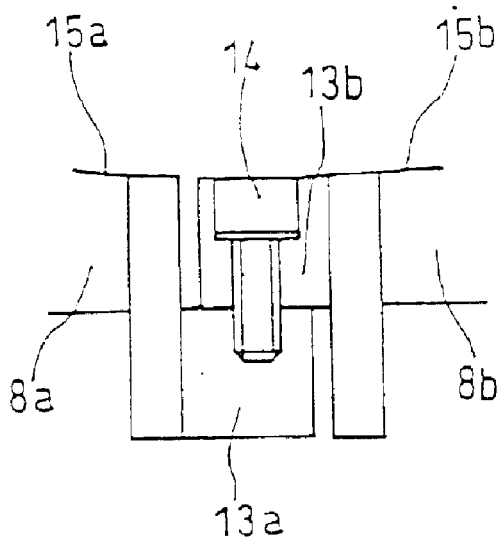
FIG. 5 is an enlarged view of a C portion in the printing press of FIG. 1.
Figure 6:
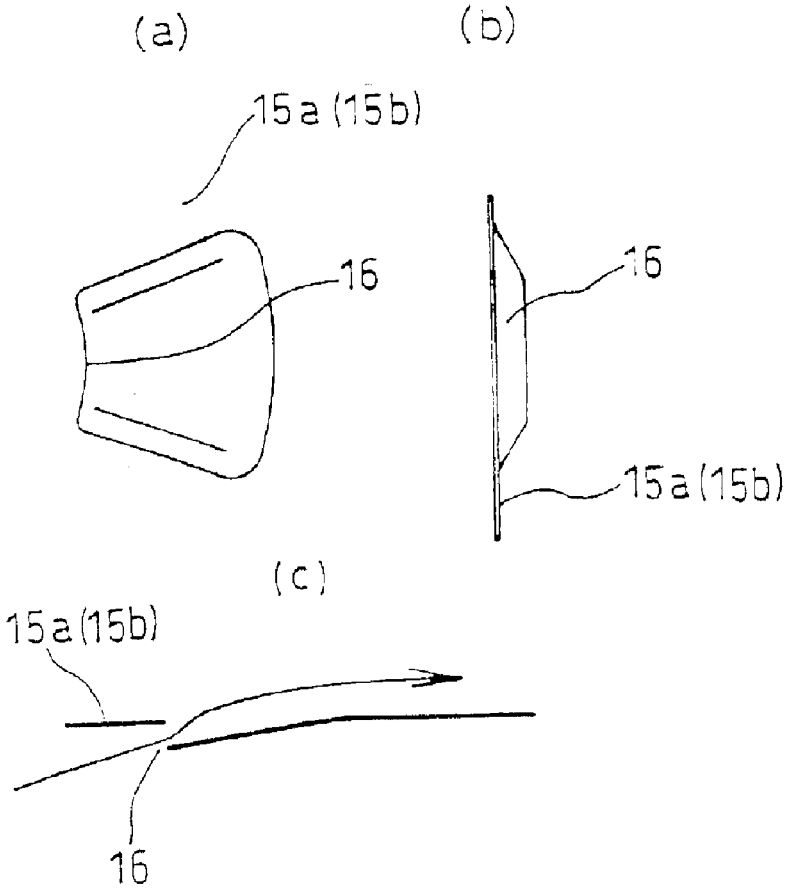
FIGS. 6(*a*) to 6(*c*) are structural explanation drawings of a guide plate in the printing press, FIG. 6(*a*) being a plan view, FIG. 6(*b*) a side view, and FIG. 6(*c*) a sectional view.
Figure 7:
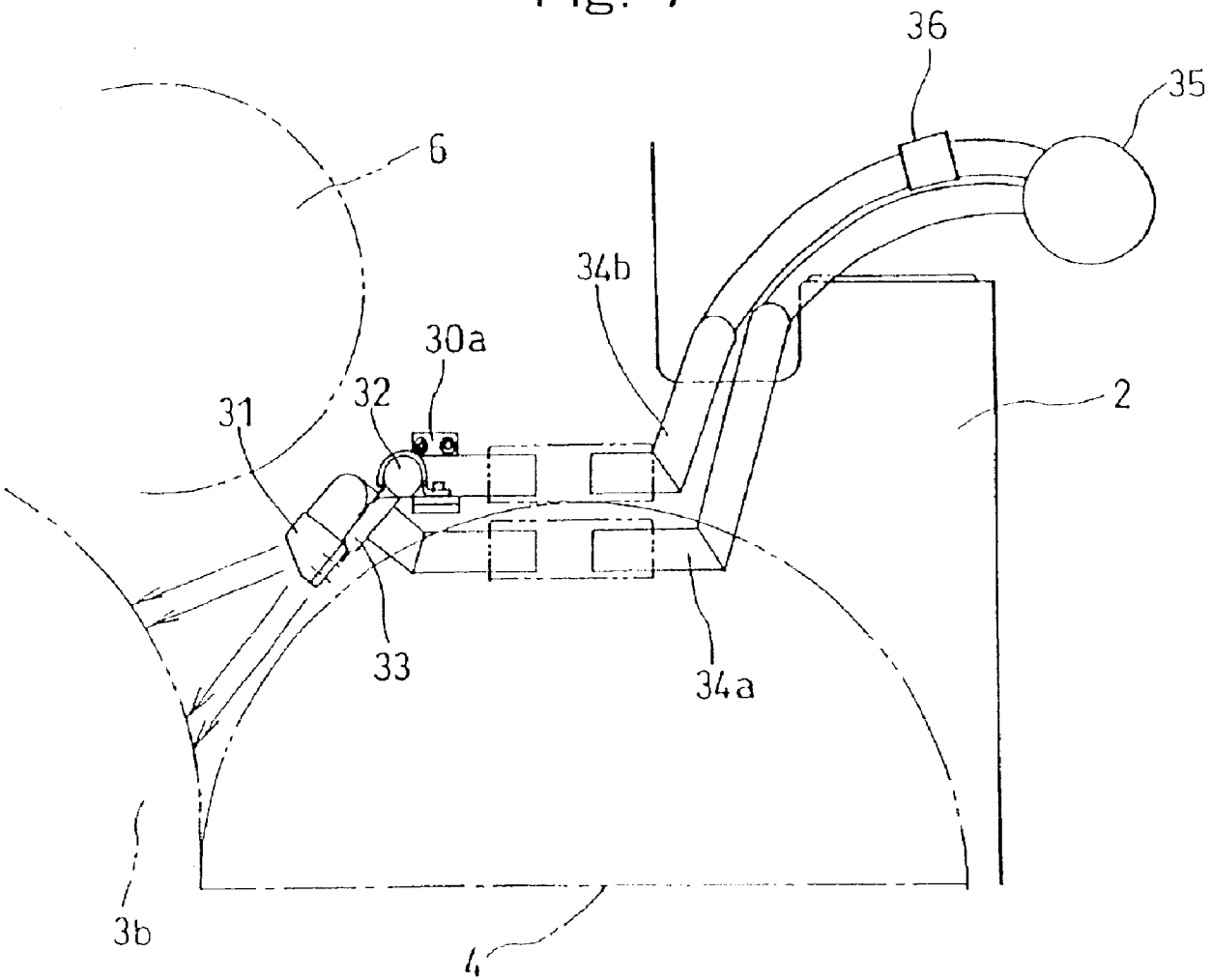
FIG. 7 is an enlarged side view of an air blower in the printing press.
Figure 8:
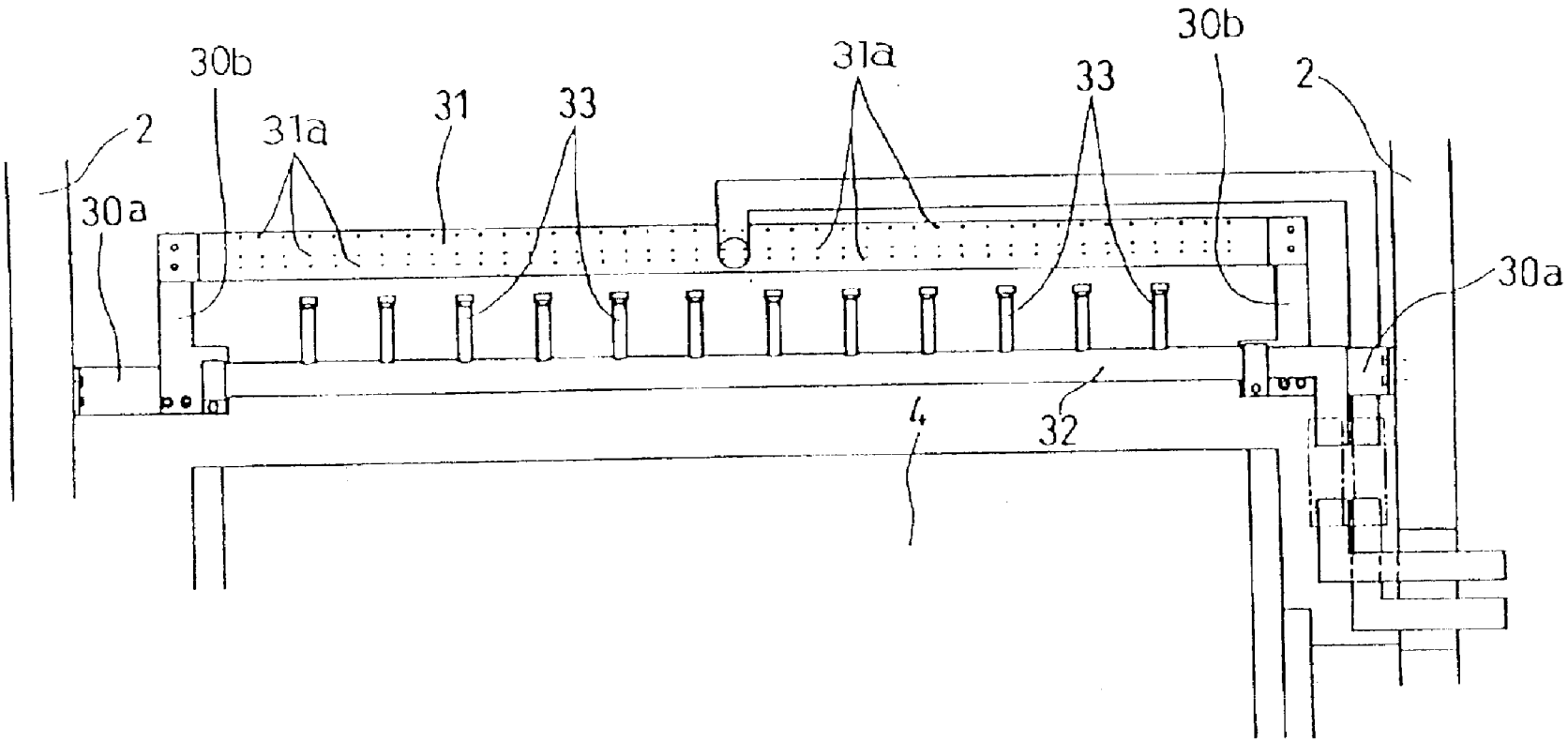
FIG. 8 is an enlarged plan view of the air blower in the printing press.
Figure 9:
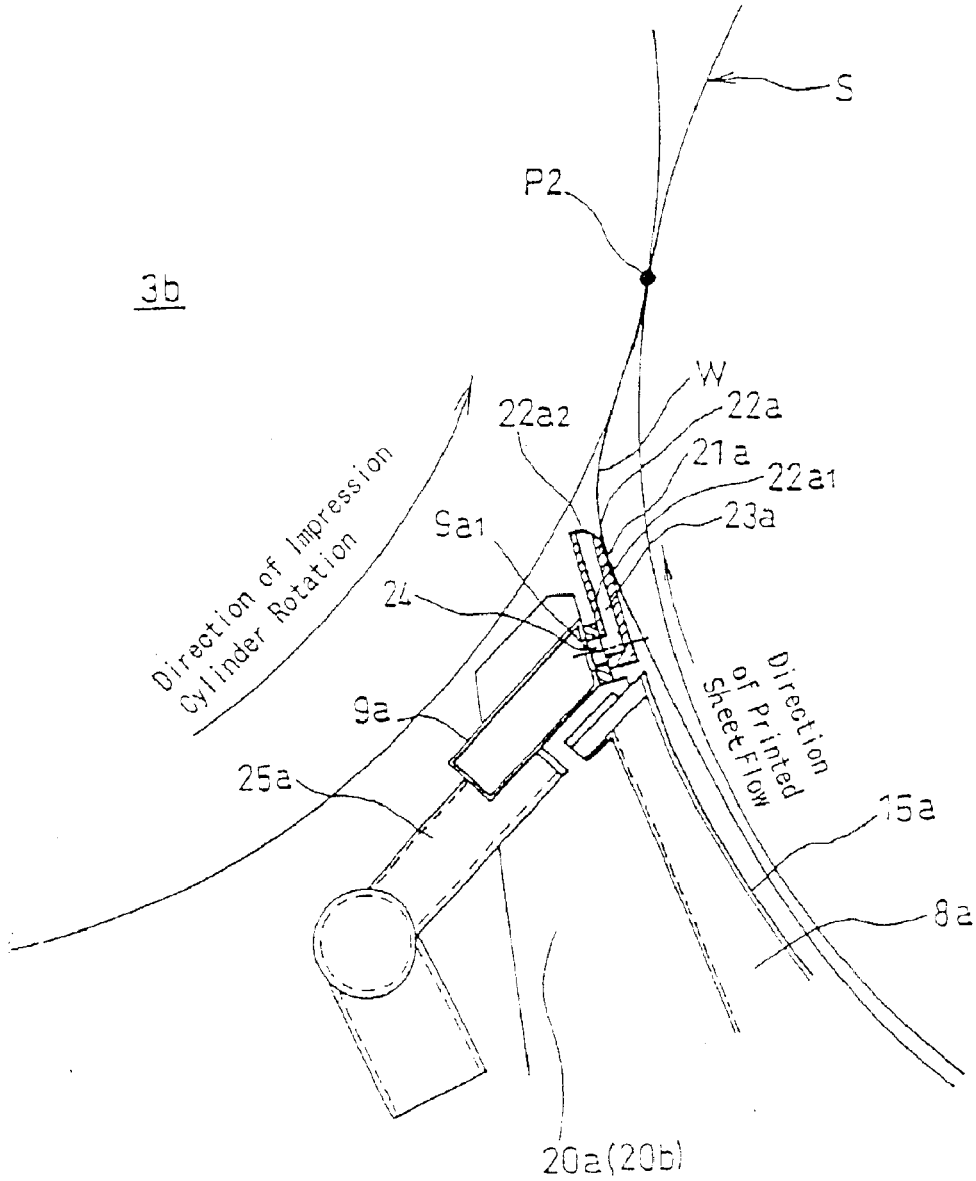
FIG. 9 is an operational explanation drawing of the guide member at a transfer position P2 of a printed sheet W.
Figure 10:
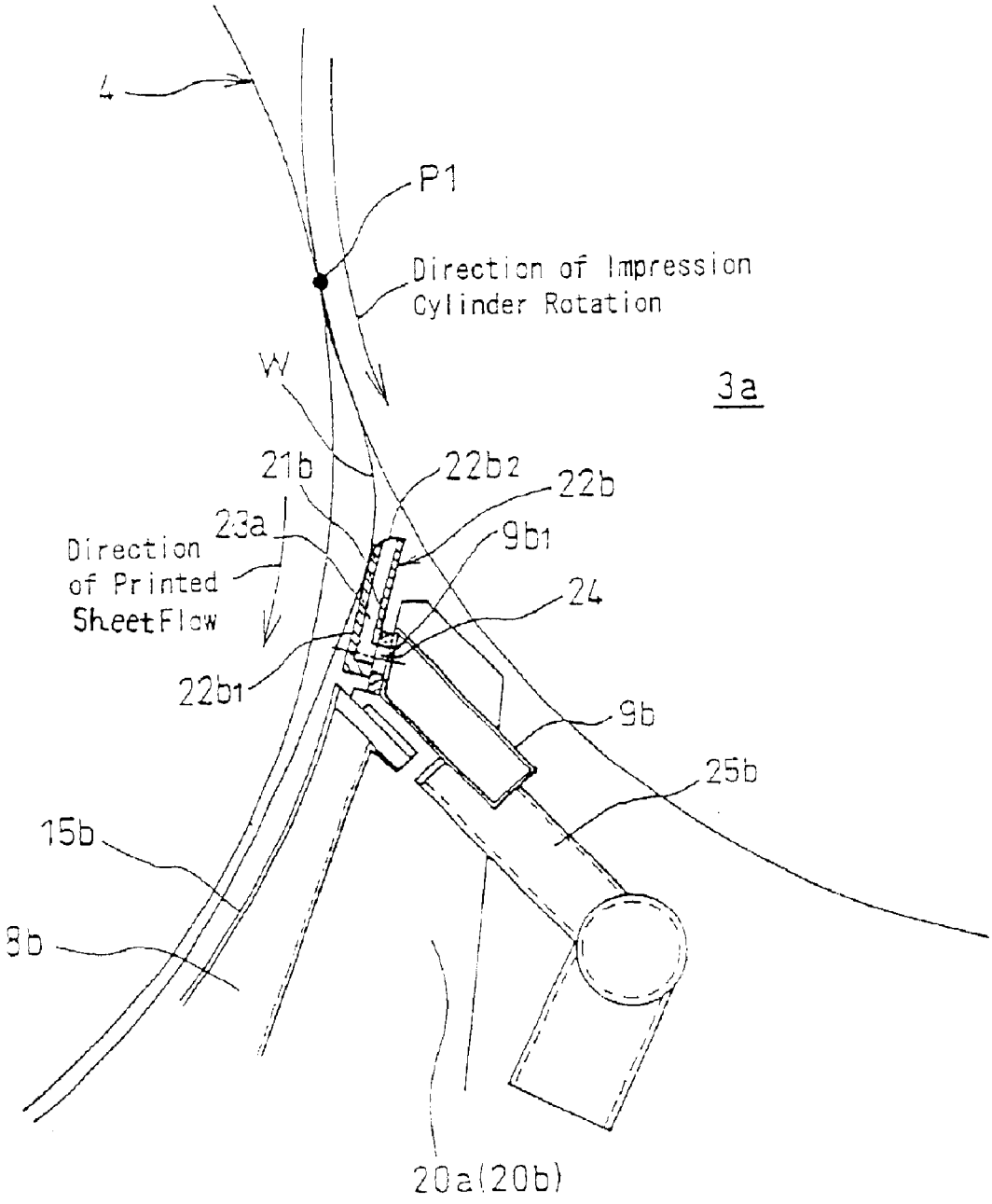
FIG. 10 is an operational explanation drawing of the guide member at a transfer position P1 of the printed sheet W.

FIG. 1 is a side view of essential parts of a multicolor sheet-fed printing press showing a first embodiment of the present invention. FIG. 2 is a plan view of a first guide apparatus (guide member) in the printing press. FIG. 3 is an enlarged view of an A portion in the printing press of FIG. 1. FIG. 4 is an enlarged view of a B portion in the printing press of FIG. 1. FIG. 5 is an enlarged view of a C portion in the printing press of FIG. 1. FIGS. 6(*a*) to 6(*c*) are structural explanation drawings of a guide plate in the printing press, FIG. 6(*a*) being a plan view, FIG. 6(*b*) a side view, and FIG. 6(*c*) a sectional view. FIG. 7 is an enlarged side view of an air blower in the printing press. FIG. 8 is an enlarged plan view of the air blower in the printing press. FIG. 9 is an operational explanation drawing of the guide member at a transfer position P2 of a printed sheet W. FIG. 10 is an operational explanation drawing of the guide member at a transfer position P1 of the printed sheet W.

In a printing section of a multicolor (e.g., four-color) sheet-fed printing press, as shown in FIG. 1, an upstream impression cylinder (second transport cylinder) 3*a* and a downstream impression cylinder (first transport cylinder) 3*b* are rotatably supported between right and left frames 2 erected on a bed 1, and a transfer cylinder 4 as transport means, consisting of a skeleton cylinder, is similarly rotatably supported between the impression cylinders 3*a* and 3*b*. The impression cylinders 3*a*, 3*b*, and the transfer cylinder 4 are each equipped with a gripper device (sheet gripping device) 5 for holding a printed sheet W (see FIGS. 9 and 10). In FIG. 1, the numeral 6 denotes a blanket cylinder, as a printing cylinder, in contact with each of the impression cylinders 3*a*, 3*b*.

Below the transfer cylinder 4, a first guide device 7A is provided, as a guide member, for guiding the printed sheet W, which is being transported, between transfer positions P1 and P2 of the printed sheet W on upstream and downstream sides in the flow direction of the printed sheet W (sheet transport direction). Above the transfer position P2 of the printed sheet W on the downstream side, a second guide device 7B is provided for guiding the printed sheet W transported by the downstream impression cylinder 3*b*.

The first guide device 7A, as shown in FIGS. 2 to 4, is divided into two portions in the flow direction of the printed sheet W, and comprises guide plates 15*a* and 15*b* covering open upper surfaces of air discharge ducts 8*a* and 8*b* extending over most of the distance between the upstream-side and downstream-side transfer positions P1 and P2 of the printed sheet W, a plate-shaped guide 22*b* disposed near the upstream-side transfer position P1 of the printed sheet W, and a plate-shaped guide 22*a* disposed near the downstream-side transfer position P2 of the printed sheet W.

The air discharge ducts 8*a* and 8*b* are supported, at the outer ends thereof, by stay bars 10*a* and 10*b* laid between the right and left frames 2 via holders 11*a* and 11*b* and blocks 12*a* and 12*b*. The inner ends of the air discharge ducts 8*a* and 8*b* are bound together by bolts 14 between bars 13*a* and 13*b*, as shown in FIG. 5.

The guide plates 15*a* and 15*b* each comprise an arcuate plate along a moving locus S of the gripper device 5 of the transfer cylinder 4. As shown in FIGS. 6(*a*) to 6(*c*), many air ejection holes 16 are formed in the guide plates 15*a* and 15*b*, and are open such that air flows rightward and leftward (in the sheet width direction of the printed sheet W) symmetrically, with respect to the center in the sheet width direction of the guide plates 15*a*, 15*b*, along the guide surface of each of the guide plates 15*a* and 15*b*.

The interior of each of the air discharge ducts 8*a* and 8*b* is supplied with pressurized air from a blower pump 19, located outside the machine, via pipelines 17*a* and 17*b*, and a collecting pipeline 18.

Between the front and rear stay bars 10*a* and 10*b* as a pair, subframes 20*a* and 20*b* are laid laterally with respect to the guide plates 15*a* and 15*b*. Bars 21*a* and 21*b* are laid between the front ends of the subframes 20*a* and 20*b* and between the rear ends of the subframes 20*a* and 20*b*. Upper surface portions of air suction ducts 9*a* and 9*b* are fixed to the lower surfaces of the bars 21*a* and 21*b*.

To an upper surface portion of the bar 21*a*, the plate-shaped guide 22*a* is fixed and extends in the sheet width direction of the printed sheet W in such a manner as to be located upstream from the transfer position P2 of the printed sheet W in the transport direction of the printed sheet W and to be brought as close as possible to the transfer position P2 of the printed sheet W. An end portion of the plate-shaped guide 22*a* a facing the transfer position P2 of the printed sheet W is formed in a comb shape, and has guide surfaces $\mathbf{22}a_1$, as guide portions, arranged parallel with predetermined spacing in the sheet width direction of the printed sheet W. This spacing is defined by notches 27*a* provided in the end portion of the plate-shaped guide 22*a* facing the transfer position 22 of the printed sheet W. Such notches 27*a* are provided at positions corresponding to a plurality of grippers, which are arranged parallel in the axial direction of the gripper device 5 of the downstream impression cylinder 3*b* and protrude from the circumferential surface of the impression cylinder 3*b*, so that these grippers can pass through the notches 27*a* without interfering with the plate-shaped guide 22*a*.

To an upper surface portion of the bar 21*b*, a plate-shaped guide 22*b* is fixed and extends in the sheet width direction of the printed sheet W in such a manner as to be located downstream from the transfer position P1 of the printed sheet W in the transport direction of the printed sheet W and to be brought as close as possible to the transfer position P1 of the printed sheet W. An end portion of the plate-shaped guide 22*b* facing the transfer position P1 of the printed sheet W is formed in a comb shape, and has guide surfaces $\mathbf{22}b_1$, as guide portions, arranged parallel with predetermined spacing in the sheet width direction of the printed sheet W. This spacing is defined by notches 27*b* provided in the end portion of the plate-shaped guide 22*b* facing the transfer position P1 of the printed sheet W. Such notches 27*b* are provided at positions corresponding to a plurality of grippers, which are arranged parallel in the axial direction of the gripper device (not shown) of the upstream impression cylinder 3*a* and protrude from the circumferential surface of the impression cylinder 3*a*, so that these grippers can pass through the notches 27*b* without interfering with the plate-shaped guide 22*b*.

In the plate-shaped guide 22*a* on the downstream side in the transport direction of the printed sheet W, many suction holes 23*a* (first suction holes), which open at the front end surfaces excluding the side surfaces and bottom surface of the notches 27*a*, namely, front end surfaces $\mathbf{22}a_2$ of the guide surfaces $\mathbf{22}a_1$, are formed in the sheet width direction of the printed sheet W. These suction holes 23*a* communicate with the interior of the air suction duct 9*a* via slots 24 and holes $\mathbf{9}a_1$ formed in the bar 21*a* and the upper surface of the air suction duct 9*a* in alignment with the suction holes 23*a* (see FIG. 3).

In the plate-shaped guide 22*b* on the upstream side in the transport direction of the printed sheet W, many suction holes 23*b* (second suction holes), which open at the front end surfaces excluding the side surfaces and bottom surface of the notches 27*b*, namely, front end surfaces $\mathbf{22}b_2$ of the guide surfaces $\mathbf{22}b_1$, are formed in the sheet width direction of the printed sheet W. These suction holes 23*b* communicate with the interior of the air suction duct 9*b* via slots 24 and holes $\mathbf{9}b_1$, formed in the bar 21*b* and the upper surface of the air suction duct 9*b* in alignment with the suction holes 23*b* (see FIG. 4).

The interior of each of the air suction ducts 9*a* and 9*b* is in communication with and is connected to a vacuum pump 29 (suction means), located outside the machine, via pipelines 25*a*, 25*b* and 26*a*, 26*b* and a collecting pipeline 28.

The second guide device 7B (air discharge means), as shown in FIGS. 7 and 8, comprises an air discharge duct 31 (first air discharge means) and an air discharge pipe 32 (second air discharge means) laid between the right and left frames 2 via support members such as L-shaped brackets 30*a* and 30*b*, the air discharge duct 31 having many discharge holes 31*a* formed in the flow direction and the sheet width direction of the printed sheet W, and the air discharge pipe 32 having many discharge nozzles 33 in the sheet width direction of the printed sheet W.

Pressurized air is supplied to the air discharge duct 31 and the air discharge pipe 32 via pipelines 34*a* and 34*b* from a blower pump 35 (discharge air source) located outside the machine. This pressurized air is blown, via the discharge holes 31*a* and the discharge nozzles 33, against the circumferential surface of the impression cylinder 3*b* located downstream from the transfer position P2 of the printed sheet W in the flow direction of the printed sheet W so as to be directed in a direction nearly perpendicular to the printed surface of the printed sheet W and in a direction opposite to the flow direction of the printed sheet W. In FIG. 7, numeral 36 denotes a valve provided in the pipeline 34*b* for supplying pressurized air from the blower pump 35 to the discharge nozzles 33 and stopping the supply of pressurized air.

Because of the above features, when the thin printed sheet W, for example, is to be transported from the impression cylinder 3*a* of the preceding printing unit to the transfer cylinder 4, and then to the impression cylinder 3*b* of the succeeding printing unit via the gripper devices 5, the following operation takes place: In a region, which is present between the front end of the plate-shaped guide 22*b* and the transfer position P1 of the printed sheet W and where the printed sheet W is not guided by the plate-shaped guide 22*b*, air in this region is directly sucked through the suction holes 23*b* opening at the front end surfaces $\mathbf{22}b_2$ of the plate-shaped guide 22*b*, whereby a strong negative pressure can be generated in this region. Consequently, as shown in FIG. 10, the printed sheet W gripped and transported by the gripper device 5 of the transfer cylinder 4 after gripping change is attracted sequentially, starting at its leading edge, toward the circumferential surface of the impression cylinder 3*a* and moved on the guide plate 15*b*. Thus, the fluttering or instability of the printed sheet W is suppressed, so that a printing trouble is prevented.

Then, on the guide plates 15*a* and 15*b*, the printed sheet W is sucked and attracted toward the guide surfaces of the guide plates 15*a* and 15*b* because of pressurized air (see the arrow in FIG. 6(*c*)) ejected through the air ejection holes 16 of the guide plates 15*a* and 15*b* and flowing in the sheet width direction, namely, from the center toward the opposite side edges of the printed sheet W, so that the printed sheet W is transported in a stable state along the guide surfaces. That is, the situation can be avoided that the printed sheet W, without ever making an unstable motion owing to the transfer cylinder 4 comprising a skeleton cylinder, causes a printing trouble.

Then, in a region, which is present between the front end of the plate-shaped guide 22*a* and the transfer position P2 of the printed sheet W and where the printed sheet W is not guided by the plate-shaped guide 22*a*, air in this region is directly sucked through the suction holes 23*a* opening at the front end surfaces $\mathbf{22}a_2$ of the plate-shaped guide 22*a*, whereby a strong negative pressure can be generated in this region. Consequently, as shown in FIG. 9, the printed sheet W being transported is attracted toward the circumferential surface of the impression cylinder 3*b*. Thus, the fluttering or instability of the printed sheet W is suppressed, so that a printing trouble is prevented.

Figure 12:
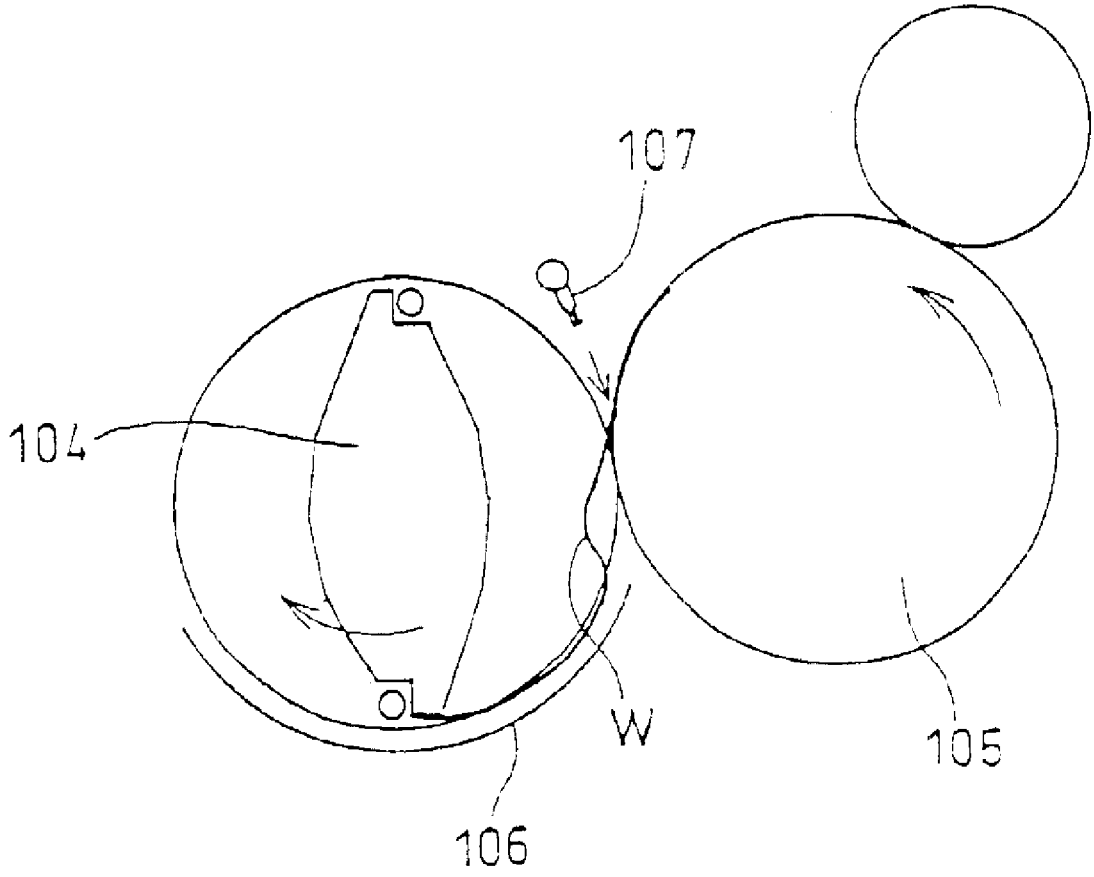
FIG. 12 is a side view of essential parts of a four-color sheet-fed printing press for illustrating a trouble with air discharge.
Figure 13:
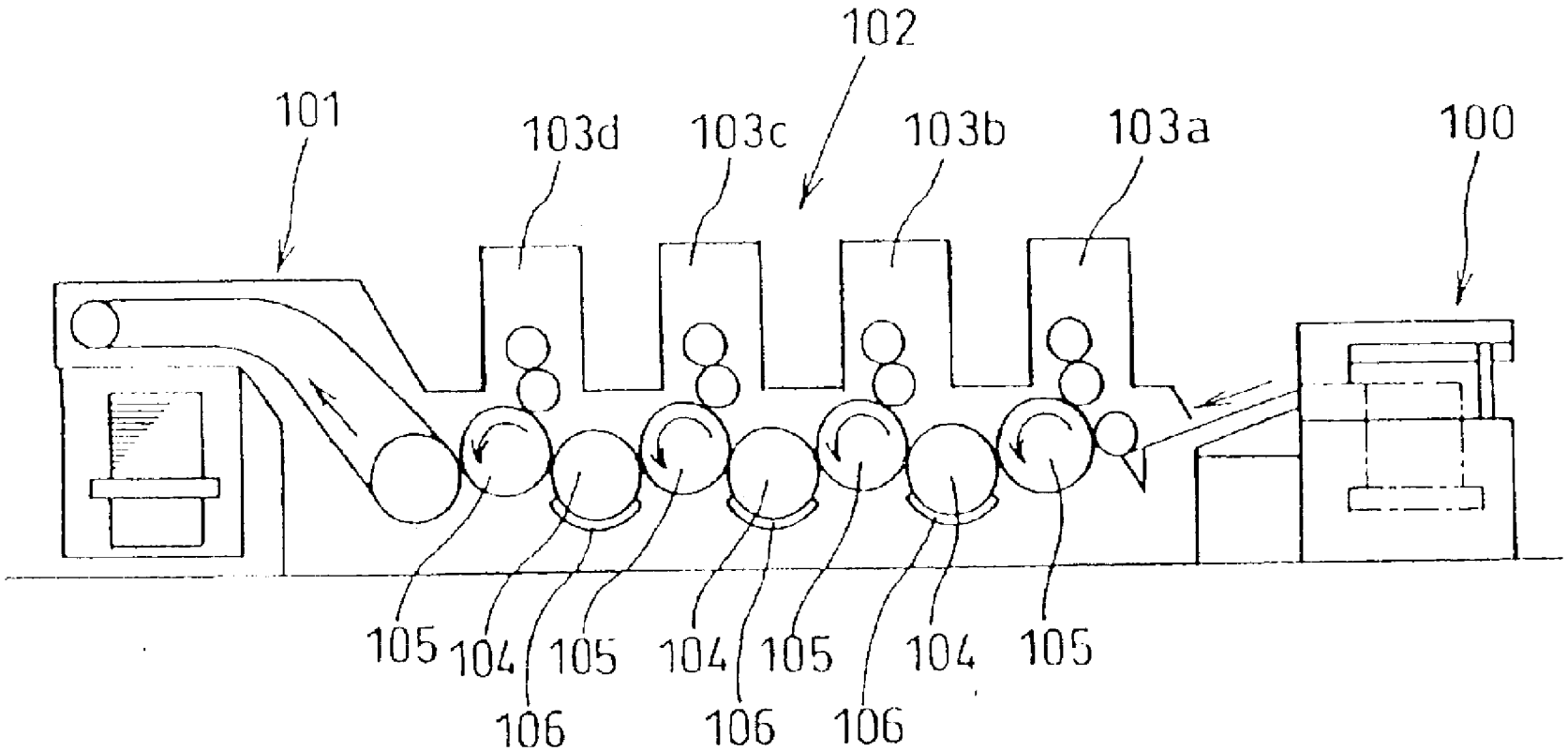
FIG. 13 is a general side view of the four-color sheet-fed printing press.

In the present embodiment, air is sucked from the extreme front end portions of the plate-shaped guides 22*a* and 22*b*, where the suction holes 23*a* and 23*b* are not enclosed with the printed sheet W. Thus, the printed sheet W is not brought into hard contact with the guide surfaces $\mathbf{22}a_1$ and $\mathbf{22}b_1$ of the plate-shaped guides 22*a* and 22*b*, so that scratches or cracks of the printed sheet W are prevented. Furthermore, the plate-shaped guides 22*a* and 22*b* serve both of a guide function and a suction function, and thus can reduce the number of components. Moreover, it does not occur that air is blown at the trailing edge of the printed sheet W as shown in FIG. 12. Thus, no sheet instability occurs at the trailing edge of the printed sheet W.

Besides, the many notches 27*a* and 27*b* are formed, with predetermined spacing in the sheet width direction of the printed sheet W, in the front end portions of the plate-shaped guides 22*a* and 22*b*, so that the grippers of the gripper devices 5 of the impression cylinders 3*a* and 3*b* do not interfere with those front end portions. Thus, the front end portions of the plate-shaped guides 22*a* and 22*b*, which do not correspond to the grippers, can be extended closer to the transfer positions P1 and P2 of the printed sheet W, and the region where the printed sheet W is not guided by the guide plates 15*a* and 15*b* can be narrowed maximally. In the aforementioned regions between the front ends of the plate-shaped guides 22*a* and 22*b* and the transfer positions P2 and P1 of the printed sheet W, air in these regions can be reliably sucked through the suction holes 23*a* and 23*b*. Thus, the transport of the printed sheet W becomes more stable.

Finally, when the printed sheet W travels past the transfer position P2 of the printed sheet W, the printed sheet W is brought into intimate contact with the circumferential surface of the impression cylinder 3*b* by pressurized air which is ejected over a predetermined length in the flow direction of the printed sheet W through the discharge holes 31*a* of the air discharge duct 31 and the discharge nozzles 33 of the air discharge pipe 32 of the second guide device 7B. As a result, fluttering or instability of the printed sheet W is suppressed, and a printing trouble is prevented. Moreover, it is desirable to operate the valve 36 to eject air through the discharge nozzles 33 if the printed sheet W is thick, and to stop the air if the printed sheet W is thin. By these means, the printed sheet W, if thick, can be pressed powerfully against the circumferential surface of the impression cylinder 3*b* by a strong combination of air blown through the discharge holes 31*a* of the air discharge duct 31 and air blown through the discharge nozzles 33 of the air discharge pipe 32, whereby fluttering or instability of the printed sheet W can be suppressed. The printed sheet W, if thin, can be pressed uniformly against the circumferential surface of the impression cylinder 3*b*, since pressurized air is ejected only through the discharge holes 31*a* of the air discharge duct 31. This confers the advantage, for example, that no wrinkles or rucks are formed by local pressurization due to air jets through the discharge nozzles 33.

In addition, the printed sheet W is transported into the region between the plate-shaped guide 22*a* and the transfer position P2 of the printed sheet W, with the marked fluttering or instability of the printed sheet W being suppressed by discharge air fed along the guide surfaces of the guide plates 15*a* and 15*b*. Thus, the efficiency of air suction through the suction holes 23*a* increases, and more stabler transport can be performed. As a result, the effect of intimate contact of the printed sheet W with the impression cylinder 3*b* by pressurized air from the second guide device 7B is dramatically enhanced to prevent the occurrence of a printing trouble and scratches or crashes of the printed sheet W.

Second Embodiment

Figure 11:
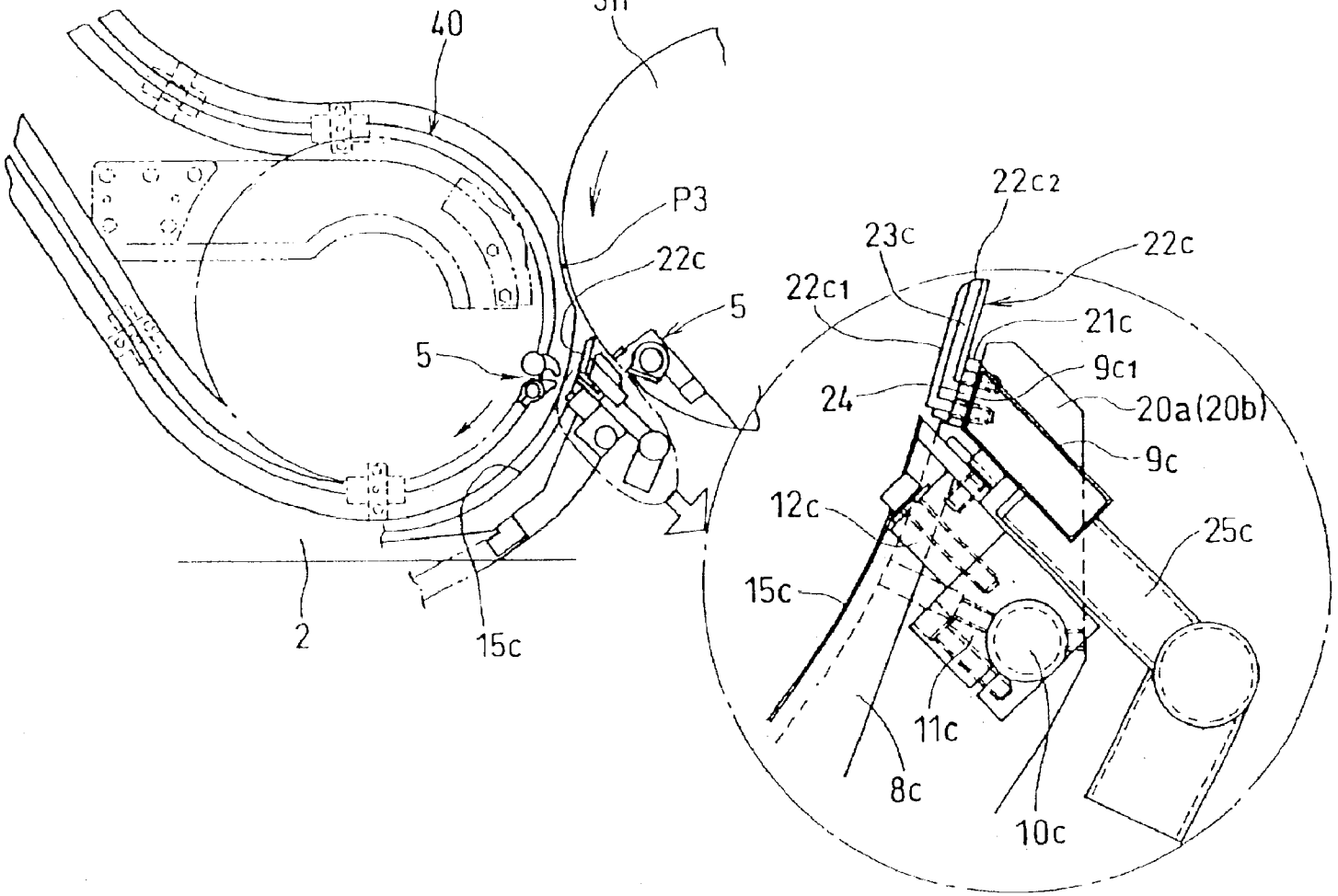
FIG. 11 is a side view of essential parts of a multicolor sheet-fed printing press showing a second embodiment of the present invention.

FIG. 11 is a side view of essential parts of a multicolor sheet-fed printing press showing a second embodiment of the present invention.

This is an embodiment in which a plate-shaped guide 22*c* of the same construction as in the first embodiment is disposed in a region where a printed sheet W is not guided by a guide plate 15*c* and an air discharge duct 8*c* (supported by a stay bar 10*c*, laid between the right and left frames 2, via a holder 11*c* and a block 12*c* as in the first embodiment) close to a transfer position P3 of the printed sheet W between an impression cylinder 3*n* of the final printing unit having a gripper device 5 and a delivery cylinder 40 of a delivery unit having a gripper device 5.

In the plate-shaped guide 22*c*, many suction holes 23*c*, which are open at front end surfaces $\mathbf{22}c_2$ of guide surfaces $\mathbf{22}c_1$, are formed in the sheet width direction of the printed sheet W. These suction holes 23*c* communicate with the interior of an air suction duct 9*c* via slots 24 and holes $\mathbf{9}c_1$ formed in a bar 21*c* and the upper surface of the air suction duct 9*c* in alignment with the suction holes 23*c*. The interior of the air suction duct 9*c* is in communication with and connected to a vacuum pump, located outside the machine, via a pipeline 25*c*, etc.

According to the above features, in the region, which is present between the front end of the plate-shaped guide 22*c* and the transfer position P3 of the printed sheet W and where the printed sheet W is not guided by the guide member, air in this region is directly sucked through the suction holes 23*c* opening at the front end surfaces $\mathbf{22}c_2$ of the plate-shaped guide 22*c*, whereby a strong negative pressure can be generated in this region. Consequently, as in the first embodiment, the printed sheet W passed on to, gripped and transported by the gripper device 5 of the delivery cylinder 40 is attracted sequentially, starting at its leading edge, toward the circumferential surface of the impression cylinder 3*a* and moved on the guide plate 15*c*. Thus, the fluttering or instability of the printed sheet W is suppressed, so that a printing trouble is prevented.

While the present invention has been described by the embodiments, it is to be understood that the invention is not limited thereby, but may be varied and modified in many other ways. For example, the plate-shaped guide may be of a construction having a flat front end surface lacking notches in the sheet width direction of the printed sheet. Also, the feature that a plurality of rod-shaped guides are arranged parallel in the sheet width direction of the printed sheet may be employed instead of the plate-shaped guide. Alternatively, the plate-shaped guide or the rod-shaped guide may have a semispherical or an arcuate extreme front end portion. The plate-shaped guide need not be a single plate having notches, but may be composed of a plurality of plates having strip-shaped front end portions. The transfer means is not limited to the skeleton cylinder, but maybe a cylinder of a cylindrical shape having a circumferential surface supporting a sheet. The transfer cylinder is not limited to the impression cylinder, but may be a blanket cylinder having means for holding a sheet, such as a gripper device. The means for holding a sheet is not limited to the gripper, but may be a suction pad. The sheet need not be a printing sheet, but may be a film. The present invention can produce the same effect even when applied to a coating device for applying a coating onto a sheet. Such variations and modifications are not to be regarded as a departure from the spirit and scope of the invention, and all such variations and modifications as would be obvious to one skilled in the art are intended to be included within the scope of the appended claims.

What is claimed is:

1. A sheet guide apparatus, comprising:

transport means for holding and transporting a sheet;

a first transport cylinder for holding and transporting the sheet received from said transport means; and a guide member for guiding the transported sheet, a first end portion of said guide member being located upstream, in a sheet transport direction, from a first transfer position where the sheet is transferred from said transport means to said first transport cylinder, said first end portion of said guide member being also located adjacent to said first transfer position, said guide member being provided with first suction holes opening at a tip of the first end portion for sucking air.

2. The sheet guide apparatus according to claim 1, wherein said guide member includes guide portions provided with spacing in a width direction of the sheet, and said tip of the first end portion includes ends of said guide portions.

3. The sheet guide apparatus according to claim 2, wherein said first transport cylinder includes holding means for holding the sheet, said guide member includes a plate-shaped member extending in the width direction of the sheet and disposed adjacent said first transfer position, and said spacing of said guide member is defined by notch portions provided in an end portion of said plate-shaped member facing said first transfer position, said notch portions corresponding to said holding means.

4. The sheet guide apparatus according to claim 1, further comprising:

a second transport cylinder for transferring the sheet to said transport means; and suction means for sucking air present between said second transport cylinder and the sheet located downstream of a second transfer position, in the sheet transport direction, where the sheet is transferred from said second transport cylinder to said transport means, said suction means having second suction holes at a position where said second suction holes are not closed by the transported sheet.

5. The sheet guide apparatus according to claim 4, wherein said second suction holes of said suction means are formed in a second end portion of said guide member, opposite to and at an upstream side of the first end portion in the sheet transport direction.

6. The sheet guide apparatus according to claim 1, further comprising:

air discharge means for discharging air onto the sheet held on said first transport cylinder to suppress instability of the sheet.

7. The sheet guide apparatus according to claim 6, wherein said air discharge means includes first air discharge means for blowing air toward a circumferential surface of said first transport cylinder located downstream, in a sheet flow direction, from said first transfer position of the sheet, said blowing being performed in a direction nearly perpendicular to a printed surface or a coated surface of the sheet, and second air discharge means for blowing air in a direction opposite to the sheet flow direction.

8. The sheet guide apparatus according to claim 6, wherein said air discharge means has first air discharge means and second air discharge means connected to a discharge air source, and said second air discharge means includes a valve for establishing and cutting off supply of discharge air.

9. The sheet guide apparatus according to claim 8, wherein said second air discharge means ejects air when the sheet has a first thickness and stops ejecting air when the sheet has a second thickness smaller than the first thickness.

10. The sheet guide apparatus according to claim 1, wherein said guide member includes a guide plate provided with a plurality of air injection holes that inject air in a width direction of the sheet.

11. The sheet guide apparatus according to claim 1, wherein said transport means is a skeleton cylinder.

12. The sheet guide apparatus according to claim 1, wherein said first transport cylinder is an impression cylinder provided downstream of said transport means in the sheet transport direction.

* * * * *